US008250670B2

(12) United States Patent
Nishikawa

(10) Patent No.: US 8,250,670 B2
(45) Date of Patent: Aug. 28, 2012

(54) GARMENT

(75) Inventor: Atsuko Nishikawa, Nagoya (JP)

(73) Assignee: Atsu Creation Ltd., Nagoya-shi (JP)

( * ) Notice: Subject to any disclaimer, the term of this patent is extended or adjusted under 35 U.S.C. 154(b) by 42 days.

(21) Appl. No.: 12/811,192

(22) PCT Filed: Feb. 12, 2010

(86) PCT No.: PCT/JP2010/052042
§ 371 (c)(1),
(2), (4) Date: Jun. 29, 2010

(87) PCT Pub. No.: WO2010/098213

PCT Pub. Date: Sep. 2, 2010

(65) Prior Publication Data

US 2011/0041233 A1 Feb. 24, 2011

(30) Foreign Application Priority Data

Feb. 25, 2009 (JP) ..... 2009-041936

(51) Int. Cl.
*A41D 1/22* (2006.01)

(52) U.S. Cl. ..... 2/74

(58) Field of Classification Search ..... 2/232, 269, 2/111, 75, 80, 141.2, 311, 312, 321, 323, 2/74, 101; 450/134, 135, 136, 137, 138, 450/142, 23, 24, 25, 34, 35, 77, 119
See application file for complete search history.

(56) References Cited

U.S. PATENT DOCUMENTS 664,214 A * 12/1900 Golden ..... 450/15
1,072,923 A * 9/1913 Bevoise ..... 2/267
1,081,814 A * 12/1913 Bevioise ..... 450/55
1,107,055 A * 8/1914 Furnas ..... 2/267
1,118,313 A * 11/1914 Smith ..... 2/109
1,120,814 A * 12/1914 Hebbard ..... 2/106
1,158,199 A * 10/1915 Furnas ..... 2/109
1,174,976 A * 3/1916 Gaines ..... 2/221
(Continued)

FOREIGN PATENT DOCUMENTS

EP 1 468 620 A1 10/2004
(Continued)

OTHER PUBLICATIONS

International Search Report for parent PCT application No. PCT/JP2010/052042.

(Continued)

*Primary Examiner* — Khoa Huynh
*Assistant Examiner* — Anna Kinsaul
(74) *Attorney, Agent, or Firm* — J-Tek Law PLLC; Jeffrey D. Tekanic

(57) ABSTRACT

A comfortable-to-wear garment is disclosed that can be easily adjusted to fit a variety of wearers having different body sizes and shapes. The garment includes an upper garment part intended to be worn on an upper half of the body. A plurality of elastic cords is attached to a body fabric portion between a waist section and a chest section of the upper garment part. Each elastic cord extends in a substantially horizontal direction and is attached to the body fabric portion by a fastener portion at respective opposite portions in the longitudinal direction of the elastic cord. A free length of each elastic cord between the respective fastener portions is adjustable.

18 Claims, 7 Drawing Sheets

U.S. PATENT DOCUMENTS

| | | | | |
|---|---|---|---|---|
| 2,299,996 | A * | 10/1942 | Kremer | 2/211 |
| 2,516,426 | A * | 7/1950 | Schimmel | 450/31 |
| 2,783,471 | A * | 3/1957 | Stone et al. | 450/124 |
| 4,139,913 | A * | 2/1979 | Garin et al. | 2/237 |
| 4,583,478 | A * | 4/1986 | Bassetti | 112/413 |
| 2004/0205877 | A1 | 10/2004 | Yin et al. | |
| 2010/0299802 | A1 * | 12/2010 | Bailey et al. | 2/70 |

FOREIGN PATENT DOCUMENTS

| | | | |
|---|---|---|---|
| JP | 4-5296 | | 5/1929 |
| JP | 37-26705 | | 10/1962 |
| JP | 55-142511 | | 10/1980 |
| JP | 59-129824 | U | 8/1984 |
| JP | 7-38112 | U | 7/1995 |
| JP | 9-217210 | A | 8/1997 |
| JP | 2000-170012 | A | 6/2000 |
| JP | 2003-227019 | A | 8/2003 |

OTHER PUBLICATIONS

Notification of Reasons for Refusal dispatched by JPO on Jun. 9, 2009 in JP2009-041936.

English translation of Written Opinion from parent PCT application No. PCT/JP2010/052042.

* cited by examiner

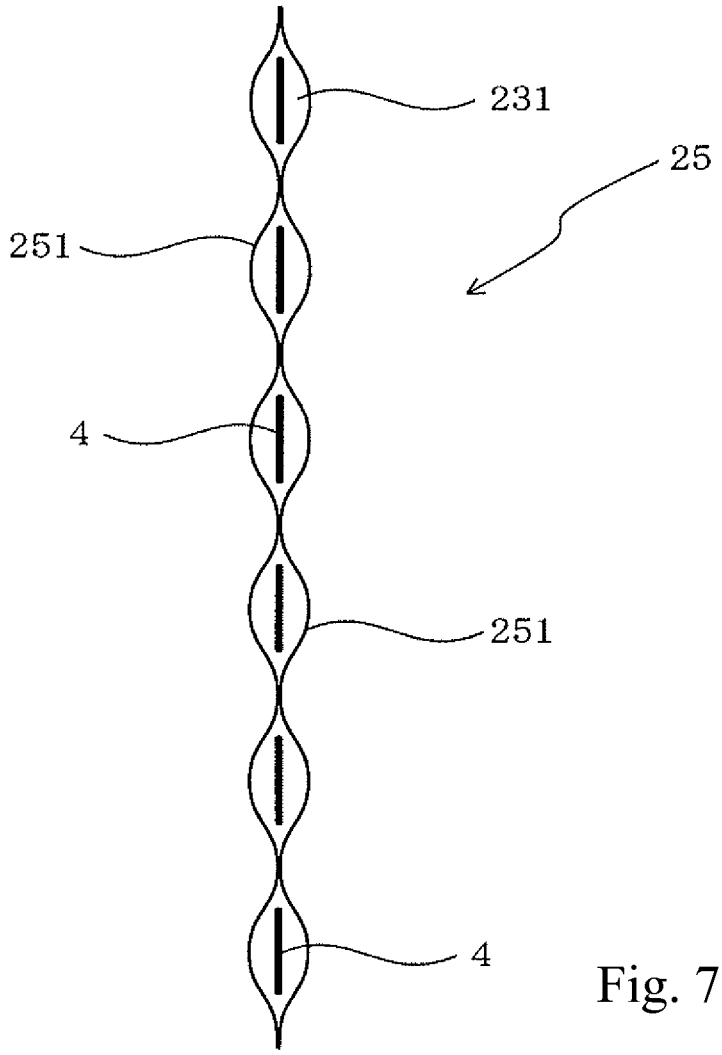
Fig. 7
Fig. 8
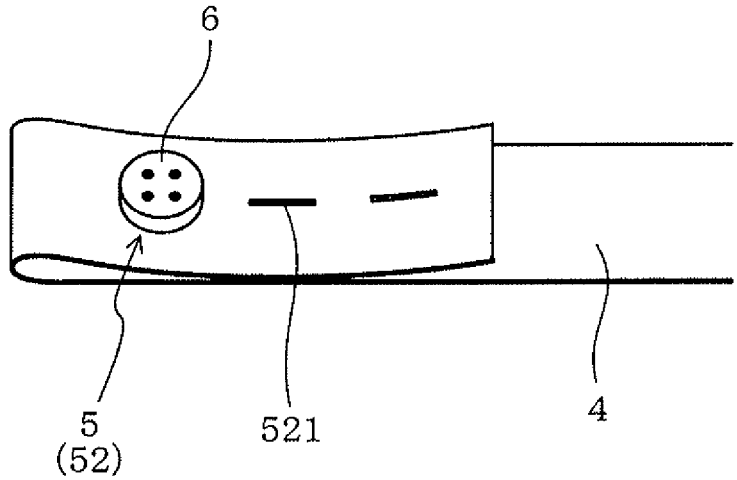

GARMENT

CROSS-REFERENCE

This application is the U.S. national stage filing of International Application No. PCT/JP2010/052042 filed Feb. 12, 2010, which claims priority to Japanese patent application no. 2009-041936 filed Feb. 25, 2009.

TECHNICAL FIELD

The present invention relates to a garment including an upper garment part worn on an upper half of the body, such as a wedding dress.

BACKGROUND ART

Garments such as wedding dresses are desired to be available in various sizes corresponding to wearers' body sizes and shapes. Realistically, however, it is difficult to provide a sufficiently wide variety of sizes for various reasons, above all because of the costs.

Body shapes differ from one wearer to another, and the proportions of the waist and chest measurements also vary widely. It is therefore sometimes necessary in the case of a garment, in particular such as a wedding dress, which must be tightly fitted to the body, to adjust not only the size of the garment overall but also the size of each of various parts thereof.

Alterations could be made in accordance with the wearer's body shape, but in that case it takes time and effort, and also, because the garment needs to be sewn, it is more prone to damage.

Accordingly, Japanese Unexamined Patent Application Publication No. 9-217210 has proposed a "wedding dress made in a small number of sizes that can be worn with a good fit by wearers of sizes from 7 to 17". In this disclosure, the wedding dress is divided into an upper dress part and a lower dress part. A slit is formed in the back of the upper dress part and the two side portions of the slit are drawn together and tightened up with a ribbon to adjust the slit width so that the upper dress part fits the body.

SUMMARY OF THE INVENTION

However, in the above-described known art, since the waist or chest size is adjusted with a ribbon, it is difficult to achieve fine adjustment and to fit the upper dress part to the body in a satisfactory manner. This may result in a feeling of unease in the wearer's appearance, a misalignment of the garment relative to the body during use, or reduced wear comfort. The size adjustment needs to be performed when the garment is being put on the wearer during dressing, which places much burden on the wearer as well as makes the adjustment work difficult.

In one aspect of the present teachings, a comfortable-to-wear garment is disclosed that can be easily adjusted to fit a variety of wearers having different body sizes and shapes.

In another aspect of the present teachings, a garment includes an upper garment part worn on an upper half of the body, and the upper garment part may be provided with a plurality of elastic cords attached thereto from a waist section to a chest section thereof in a substantially horizontal direction, each of the elastic cords may have fastener portions secured to a body fabric portion of the upper garment part at two locations in a longitudinal direction thereof, and each of the elastic cords may be formed such that a free length between the fastener portions is adjustable.

In this aspect of the present teachings, the plurality of elastic cords are attached to the upper garment part from the waist section to the chest section thereof, each elastic cord being secured to the body fabric portion of the upper garment part at two locations in the longitudinal direction. The free length between the fastener portions of each respective elastic cord is adjustable. Accordingly, the upper garment part can be made to fit the body at various locations from the waist section to the chest section. Therefore, a single-size garment can be adapted for wearers of various different body sizes and shapes.

Namely, because the respective free lengths of the plurality of elastic cords attached to the upper garment part from the waist section to the chest section thereof can be adjusted separately, the upper garment part can be adapted for each wearer's size at each of various locations from the waist section to the chest section. Thereby, the garment can be adapted for many wearers who may have various different proportions of waist and chest measurements. For example, for a wearer who has a large chest measurement relative to the waist measurement, the free lengths between the fastener portions of the elastic cords disposed in the waist section are shortened, while the free lengths between the fastener portions of the elastic cords disposed in the chest section are lengthened. Or, for a wearer who has a large waist measurement, such as a pregnant woman, the free lengths between the fastener portions of the elastic cords disposed in the waist section are lengthened, while the free lengths between the fastener portions of the elastic cords disposed in the chest section are shortened.

Moreover, because the elastic cords have elasticity, fine adjustment of the waist or chest size in each part can be achieved by the stretching properties of the elastic cords, and further the elasticity of the elastic cords can provide a better fit for the body. Namely, the free length of each elastic cord is adjusted to a length somewhat shorter than the length corresponding to the waist or chest measurement of each part of the wearer's body, so that, when the garment is worn, the elastic cords are stretched to some extent and the upper garment part can fit the body due to the restoring force of the elastic cords. This can also prevent misalignment of the garment when being worn and improve wear comfort.

While it would ordinarily be difficult to make a garment of the known art fit wearers having different body sizes or shapes only with the elasticity of the elastic cords, the free length between the fastener portions of each elastic cord is changed individually in this aspect of the present teachings, whereby the synergy effects of the free length adjustment of the elastic cords and the elasticity or stretching properties of the elastic cords make it possible to accommodate various different body sizes and shapes of wearers.

Namely, if the elastic cords were secured to the body fabric portion at both ends so that the free lengths between the fastener portions were not changeable, the garment could not be adapted for a waist or chest measurement that is smaller than the waist or chest size of the garment when the lengths of the elastic cords equal their free lengths (the most contracted length). On the contrary, if the waist or chest size of the garment when the lengths of the elastic cords equal their free lengths were much too small, the garment could not be adapted for a large waist or chest measurement with the elasticity of the elastic cords alone. It would be even more impossible to adapt the garment for many wearers who may have various different proportions of waist and chest measurements.

On the other hand, if the free length adjustability of the elastic cords is combined with the elasticity of the elastic cords, the garment can be adapted for wearers of various sizes, as well as for many wearers who may have various different proportions of waist and chest measurements.

The size adjustment only requires adjustment of the free length between the fastener portions of each elastic cord before the garment is worn, so the adjustment work is easy. Moreover, since it is not necessary to make adjustments while the garment is being put on the wearer during dressing, the wearer's burden is reduced and even the wearer can perform the adjustment herself.

Also, since no size alteration is required, no sewing operation is required for the garment so that there are no worries that the garment may be damaged.

For sellers or renters of the garment, too, there is an advantage that they do not have to keep an inventory of many sizes for the garment of the same design. They will instead be able to have an inventory of garments of various different designs at lower prices, leading to another advantage of a wider range of design selections for users such as buyers.

BRIEF DESCRIPTION OF THE DRAWINGS

FIG. 7 is a view corresponding to a cross section along the line A-A viewed in the direction of the arrows of FIG. 1.

FIG. 8 is a perspective view of the movable fastener in the embodiment.

DETAILED DESCRIPTION FOR CARRYING OUT THE INVENTION

Figure 1:
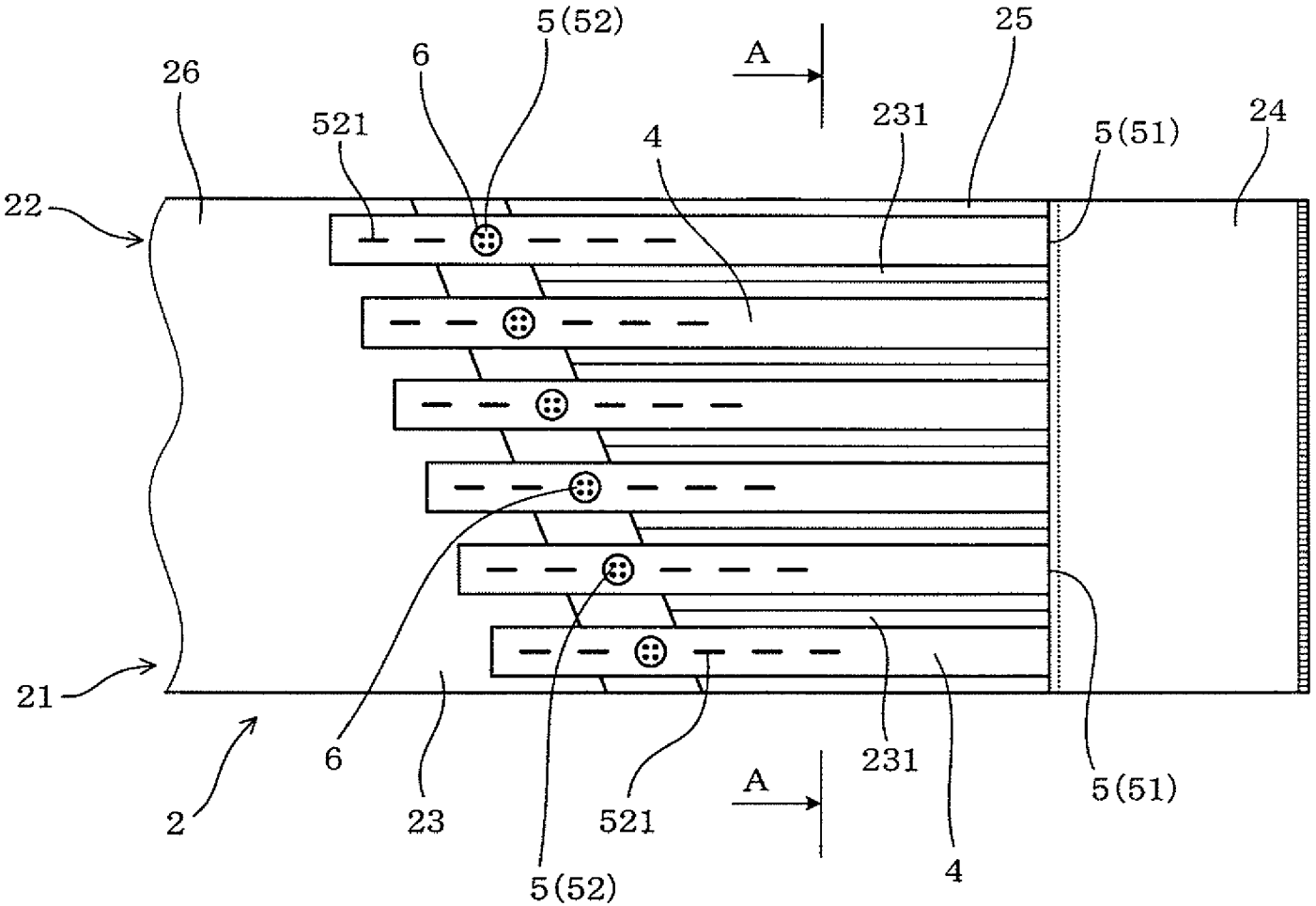
FIG. 1 is a development view of a part of an upper garment part with a plurality of elastic cords attached thereto in one embodiment.

Herein, the "free length between fastener portions" means the length between the fastener portions in a state in which no external force is applied to the elastic cords, i.e., the length in the most contracted state.

Preferably, one of the fastener portions of the elastic cords is a stationary fastener portion that is secured to the body fabric portion, while the other of the fastener portions is a movable fastener portion movable in the longitudinal direction of the elastic cord.

In this case, attachment strength of the elastic cords to the body fabric portion can be secured. It also simplifies the structure of the garment, and enables the garment to be readily made at low cost.

Preferably, each movable fastener portion is made up of a plurality of buttonholes and a button secured to the body fabric portion, and is formed such that the free length between the fastener portions can be adjusted by engaging the button with one of the buttonholes.

In this case, the adjustment of the free length between the fastener portions can be performed easily.

Preferably, the upper garment part includes patch portions that cover the buttons from the side of the wearer's body.

It is prevented that the buttons contact the body when the garment is being worn, thereby improving the wear comfort.

A lower garment part worn on a lower half of the body is preferably formed integrally with the upper garment part.

In this case, because of the heavy weight of the entire garment including the lower garment part, it is necessary for the elastic cords in the upper garment part to have a larger force for retaining the garment on the body. Therefore, it is of great significance that the garment is retained at its upper garment part on the upper half of the body by adjusting the free lengths between the fastener portions of the elastic cords to make the upper garment part fit the upper half of the body, as in the present invention.

Namely, if the waist or chest size is adjusted with non-elastic strings or the like without using the elastic cords, a sufficient retaining force to keep the garment on the body cannot be obtained, which may cause an unwanted possibility of the garment slipping off while being worn. On the other hand, such worries can be resolved by using the elastic cords.

The garment is preferably formed to be secured to the wearer's body only at the waist section and the chest section of the upper garment part.

In this case, the upper garment part requires the force provided by the elastic cords to retain the garment on the body. This embodiment is different from a garment having shoulder portions or shoulder straps that can support the weight of the garment if these shoulder straps are not present, the garment must be retained on the body by the force that tightens up the waist section and the chest section of the upper garment part onto the upper half of the body. Therefore, it is of great significance that the garment is retained at its upper garment part on the upper half of the body by adjusting the free lengths between the fastener portions of the elastic cords to make the upper garment part fit the upper half of the body.

The garment preferably includes covering cloth portions that cover, from the outside, parts of the body fabric portion where the elastic cords are attached.

Thereby, a garment with an improved appearance design quality can be provided. Namely, the parts of the body fabric portion where the elastic cords are attached are particularly prone to wrinkles. Even if the design is such that wrinkles are permissible, the wrinkles may sometimes turn out to be aesthetically displeasing depending on how the adjustment was done. Therefore, by covering such parts with the covering cloth portions, the garment can have an improved appearance design quality.

Preferably, the elastic cords are arranged in both left and right side portions.

Thereby, the upper garment part can be made to fit the body with a good balance. Also, since the parts where the elastic cords are attached are not conspicuous in appearance, the garment as a whole can have an improved appearance design quality.

The garment is preferably a rental garment article.

The present teachings are particularly advantageous with rental garments, because the characteristic feature of a rental garment is that a single garment article is worn by many individuals. Because garments according to the present teachings can be readily adapted or adjusted for wearers of various different body sizes and shapes, such a garment can fully meet the needs characteristically associated with rental garments.

Moreover, renters no longer need to keep an inventory of many sizes for the garment of the same design. They will instead be able to have an inventory of garments of various different designs at lower prices, leading to another advantage of a wider range of design selections for users.

The garment is preferably a wedding dress.

The present teachings are also particularly advantageous with wedding dresses, because wedding dresses are worn only at weddings and are very expensive to make them to order. Therefore, the wedding dress is particularly desired to be adaptable or adjustable for wearers of various different body sizes or shapes.

In general, a bride-to-be is busy in not only preparing a wedding dress but also in preparing for the marriage overall, and so it is arduous for her to do many trial fittings for fine adjustment for any necessary alterations. It is also not unusual that the bride loses or gains weight shortly before the wedding. In such a case, too, the garment of the present invention can be readily adapted. There is another advantage that even if the bride-to-be is pregnant, the garment can be adapted for a body shape that changes day by day shortly before the wedding.

Furthermore, since the wearer wants her appearance to be particularly good when wearing the wedding dress, by utilizing a garment of the present teachings that can be easily made to fit the bride's body shape, the desired effects can be readily achieved.

Embodiment

A garment according to one embodiment of the present invention will be described with reference to FIG. 1 to FIG. 8.

Figure 4:
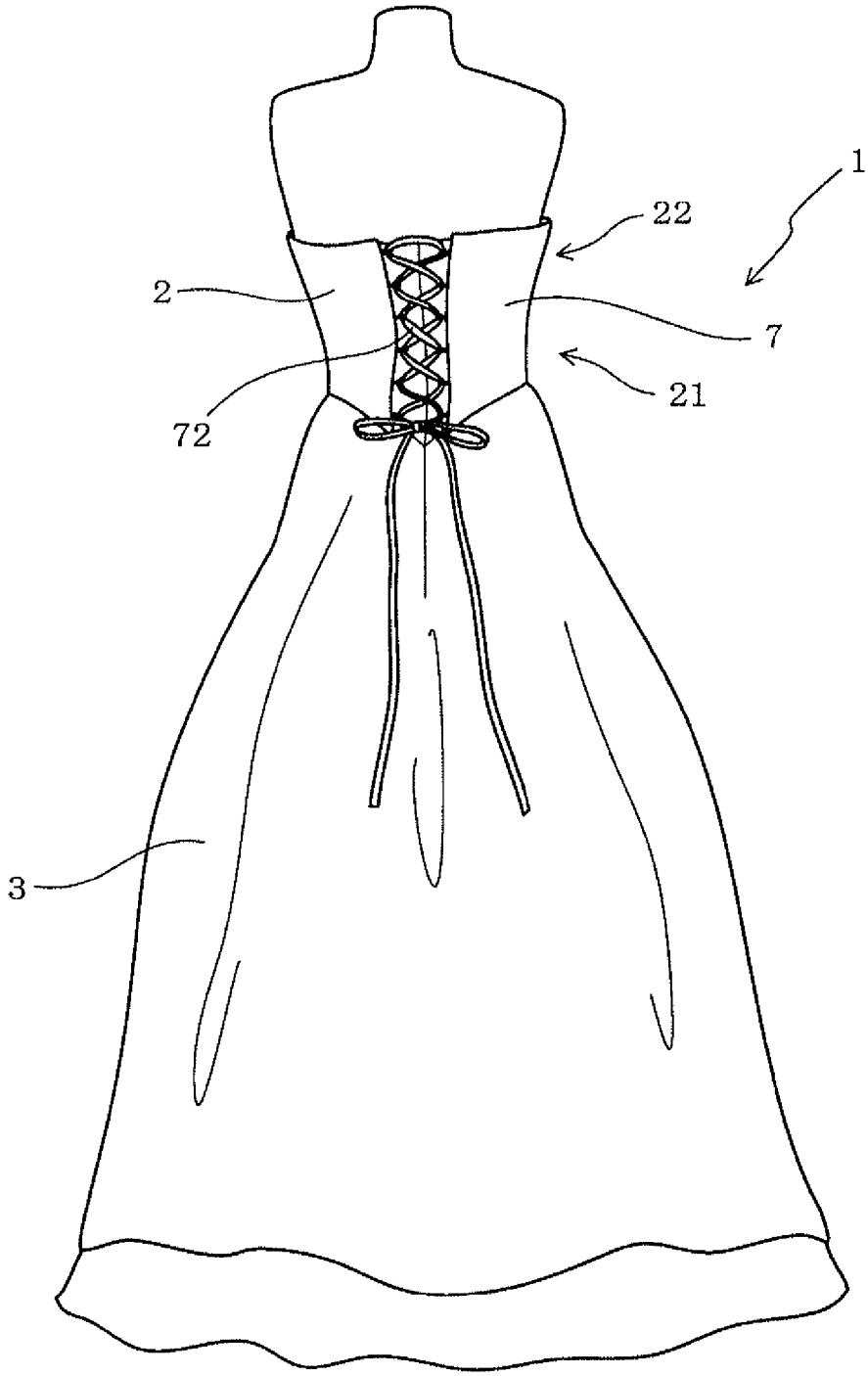
FIG. 4 is an overall perspective view from behind of the garment being worn in the embodiment.

The garment 1 of this embodiment is a so-called one-piece garment, as shown in FIG. 4, which is a garment having an upper garment part 2 worn on an upper half of the body and a lower garment part 3 worn on a lower half of the body formed in one piece. The garment 1 of this embodiment is a wedding dress.

The garment 1 is formed such that it is secured to the wearer's body only at a waist section 21 and a chest section 22 of the upper garment part 2. Namely, as shown in FIG. 2 to FIG. 4, the garment 1 is a so-called bustier dress that has no shoulder portions or shoulder straps.

Figure 2:
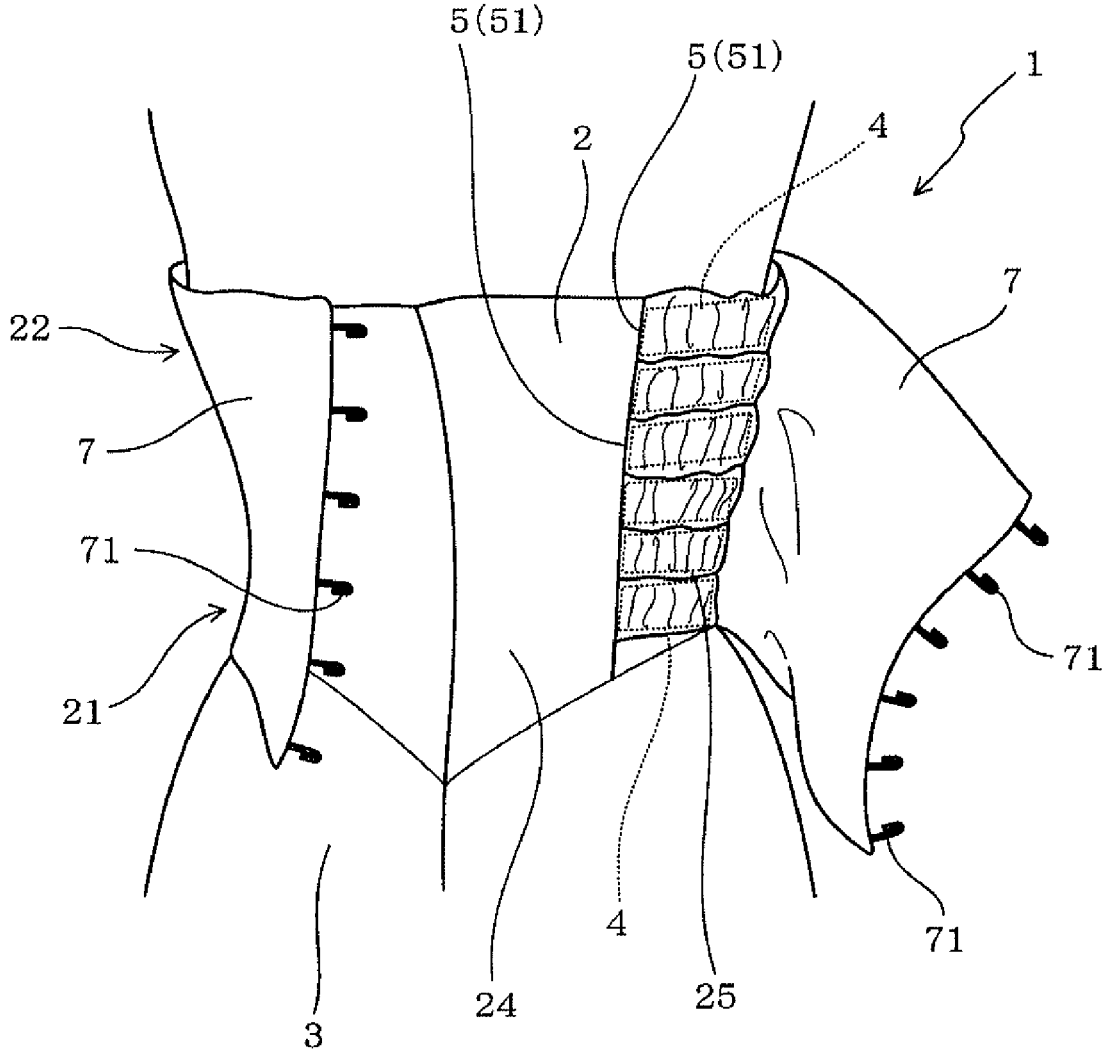
FIG. 2 is a perspective view of the garment near the upper garment part, with covering cloth portions being opened in the embodiment.
Figure 3:
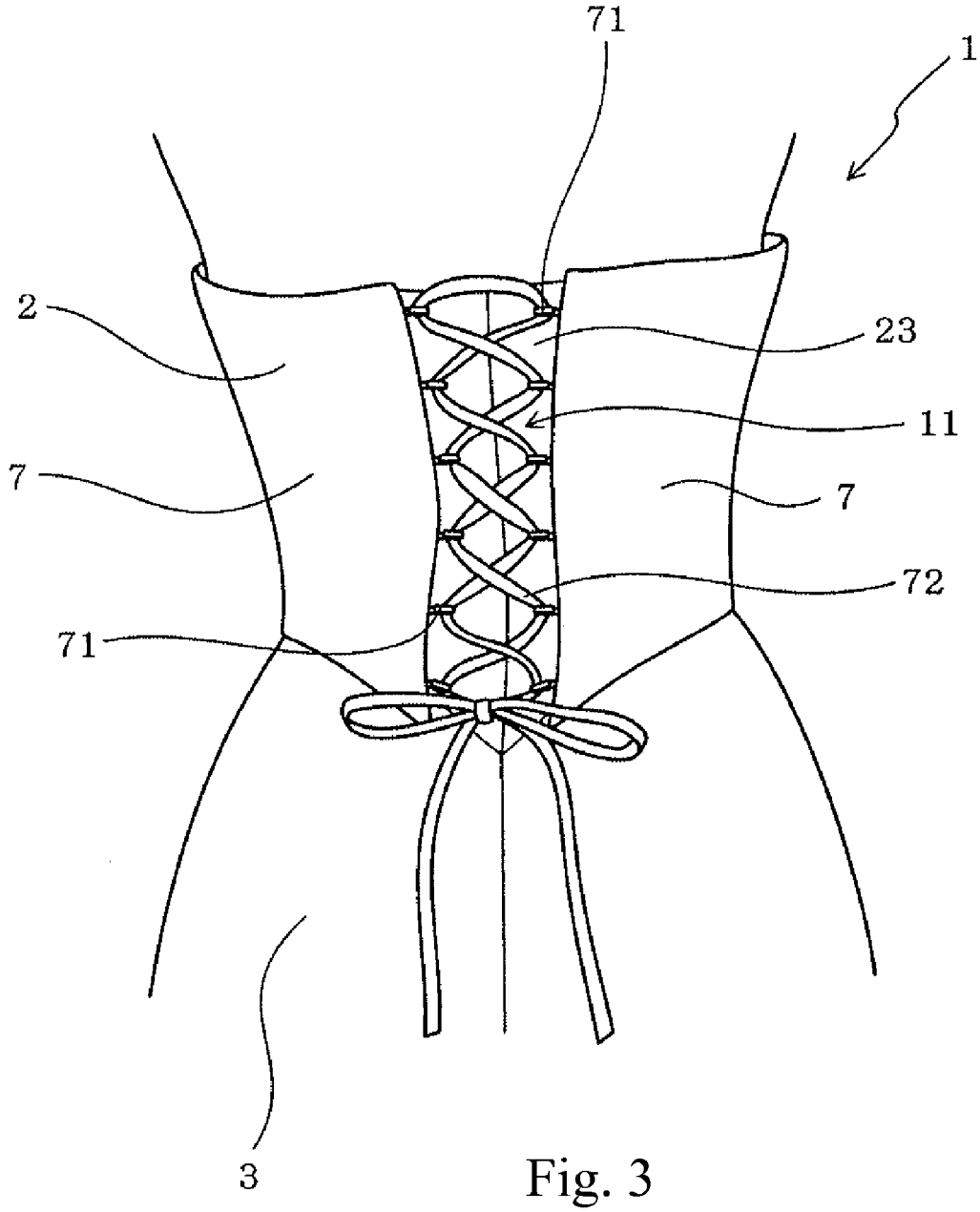
FIG. 3 is a perspective view of the garment near the upper garment part, with the covering cloth portions being tightened up in the embodiment.

As shown in FIG. 1 and FIG. 2, the upper garment part 2 is formed to have a plurality of elastic cords 4 attached thereto, from the waist section 21 to the chest section 22 thereof in a substantially horizontal direction. Each elastic cord 4 has fastener portions 5 secured at two locations in the longitudinal direction thereof where it is fastened to a body fabric portion 23 of the upper garment part 2. Each elastic cord 4 is formed such that the free length between the fastener portions 5 is adjustable.

One of the fastener portions 5 of the elastic cord 4 is a stationary fastener portion 51 which is fixed to the body fabric portion 23, while the other fastener portion 5 is a movable fastener portion 52 which is movable in the longitudinal direction of the elastic cord 4. The movable fastener portion 52 is made up of a plurality of buttonholes 521, and is formed such that the free length between the fastener portions 5 can be adjusted by engaging a button 6 fixed to the body fabric portion 23 with one of the buttonholes 521.

Figure 5:
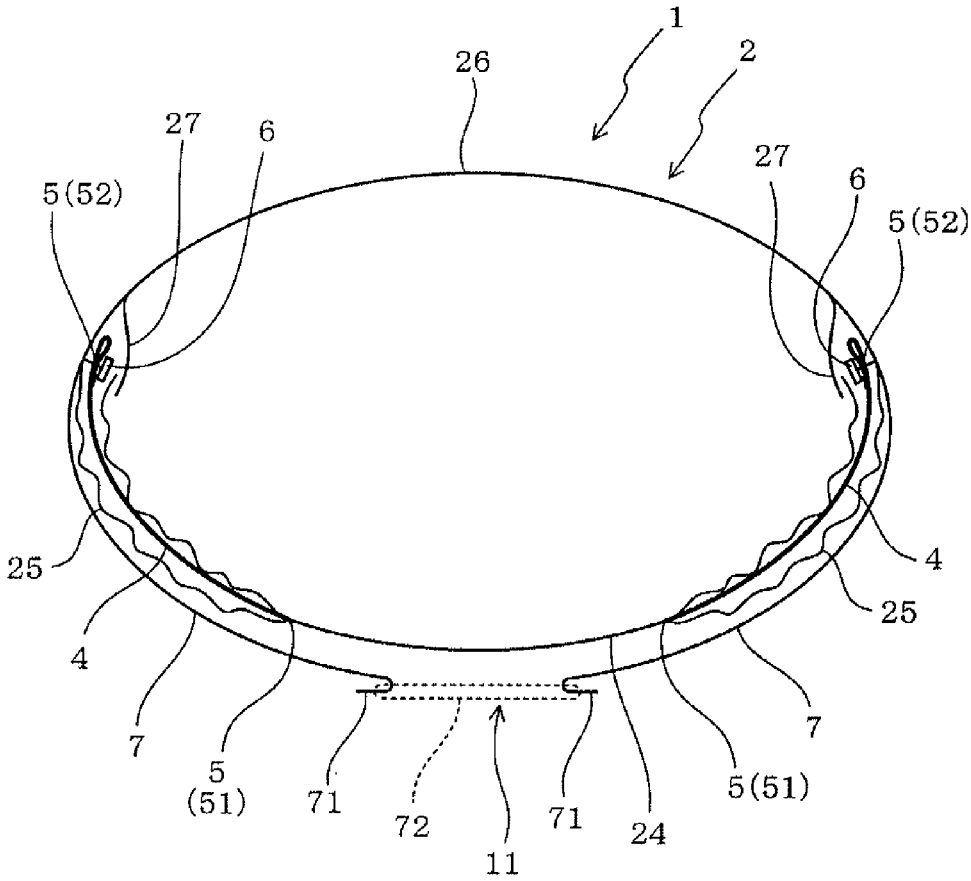
FIG. 5 is a horizontal cross sectional view of the garment being worn in the embodiment.

As shown in FIG. 5, the upper garment part 2 is made up of a back portion 24 that is placed in a middle part of the back of the body, a front portion 26 placed on the front side of the body, and side portions 25 placed on both sides toward the back of the body and connecting the back portion 24 and the front portion 26. The elastic cords 4 are arranged in both of the left and right side portions 25.

The elastic cord 4 has a band-like shape, one end of which is sewn to the body fabric portion 23, thereby forming the stationary fastener portion 51. The stationary fastener portions 51 are positioned respectively at the left and right ends of the back portion 24, from which the elastic cords 4 extend toward the front portion 26 side. As shown in FIG. 1, the plurality of buttonholes 521 are provided at intervals of, for example, 1 to 3 cm from near the ends of the elastic cords 4 that are opposite from the stationary fastener portions 51.

Each of the buttons 6 to be engaged with one of the buttonholes 521 is sewn near the front ends of the side portions 25 so as to be provided for the respective elastic cords 4 one-on-one.

One of the buttonholes 521 of each elastic cord 4 is selected in accordance with the measurement of each part of the wearer, the button 6 being fitted in this buttonhole 521. Thereby, the free length of each part in the height direction of the side portions 25 is determined as the length corresponding to the free length between the fastener portions 5 (between stationary fastener portion 51 and movable fastener portion 52) of each elastic cord 4. If an end portion is too long on the movable fastener portion 52 side of the elastic cord 4 left from the button 6 to the distal end, as shown in FIG. 6 and FIG. 8, this portion is folded back and secured by the button 6 at a buttonhole 521 on the distal end side.

Figure 6:
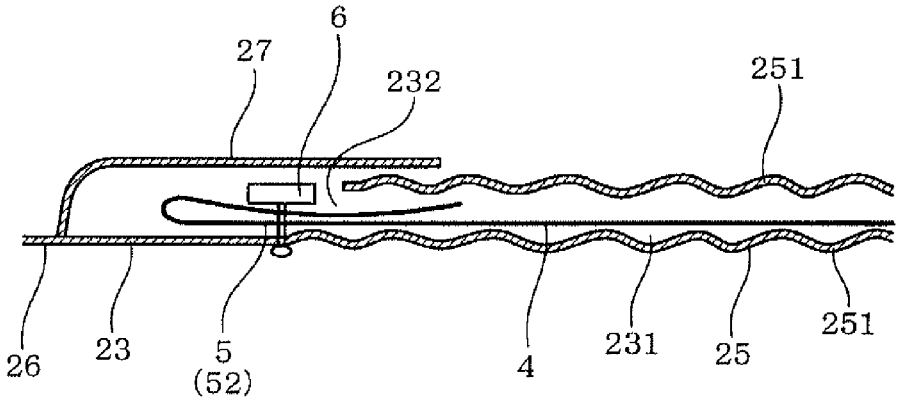
FIG. 6 is a cross sectional view along the longitudinal direction of the elastic cord near a movable fastener in the embodiment.

The side portions 25 of the body fabric portion 23 include through holes 231 between a pair of fabric layers 251, through which the elastic cords 4 are inserted, as shown in FIG. 6 and FIG. 7. The elastic cords 4 are inserted through the through holes 231 from the stationary fastener portions 51 to near the movable fastener portions 52. There are a plurality of through holes 231, so that each elastic cord 4 is inserted through each through hole 231. The through hole 231 has an opening 232 on the side of the movable fastener portion 52, which is located outside the through hole 231. In other words, the buttons 6 are sewn to the body fabric portion 23 outside the openings 232 of the through holes 231.

As shown in FIG. 5 and FIG. 6, the upper garment part 2 has patch portions 27 that cover the buttons 6 from the side of the wearer's body. The patch portions 27 are formed so as to cover the openings 232 of the through holes 231, too.

As shown in FIG. 2, FIG. 3, and FIG. 5, the garment 1 includes a pair of covering cloth portions 7 that cover parts of the body fabric portion 23 where the elastic cords 4 are attached, i.e., the side portions 25 of the body fabric portion 23 from outside. As shown in FIG. 5, the covering cloth portions 7 are secured at their front ends to the left and right ends of the front portions 26. The covering cloth portions 7 are provided with a plurality of hooks 71 at the rear ends.

A ribbon 72 is engaged with the hooks 71 provided on the left and right covering cloth portions 7 to draw them together and tighten up as shown in FIG. 3. At this time, a slit 11 is formed between the left and right covering cloth portions 7, this slit 11 being arranged in the middle of the back of the wearer. Adjusting the width of the slit 11 in accordance with the body size of the wearer will make the covering cloth portions 7 fit the body shape.

The covering cloth portions 7 may be provided with decorations on the surface so as to improve the appearance design quality.

Next, the effects achieved by this embodiment will be described.

The garment 1 of this embodiment includes, as shown in FIG. 1 and FIG. 2, a plurality of elastic cords 4 attached to the upper garment part 2 from the waist section 21 to the chest section 22 thereof, each elastic cord 4 being secured to the body fabric portion 23 of the upper garment part 2 at two locations in the longitudinal direction. The free length between the fastener portions 5 of each respective elastic cord 4 is adjustable. Accordingly, the upper garment part 2 can be made to fit the body at every location from the waist section 21 to the chest section 22. Therefore, the garment 1 can be adapted for wearers of various different body sizes and shapes, with just one size.

Figure 9:
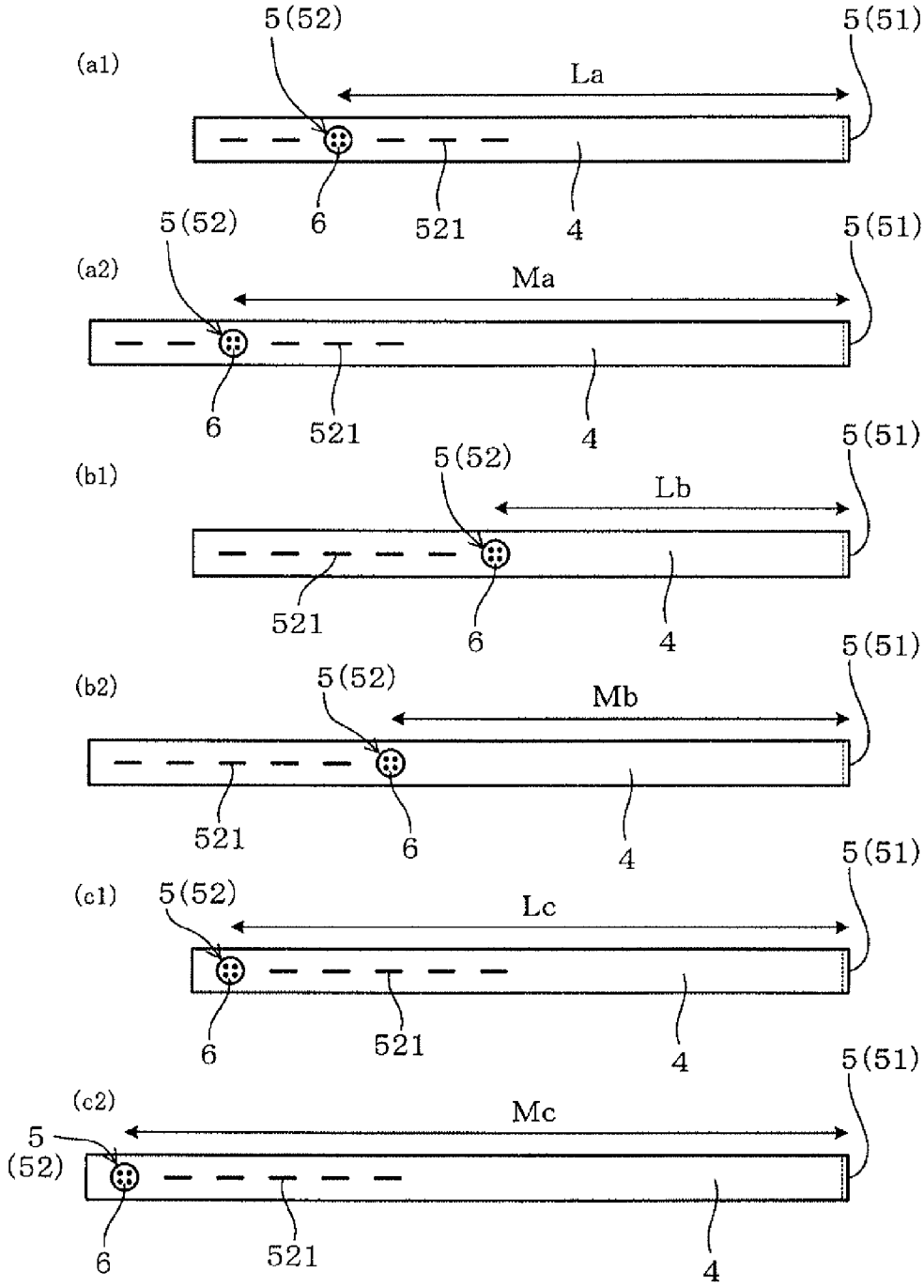
FIG. 9 is a view provided to explain the length adjustment of the elastic cords in the embodiment.

Namely, because the respective free lengths of the plurality of elastic cords 4 attached to the upper garment part 2 from the waist section 21 to the chest section 22 can be adjusted separately, the upper garment part 2 can be adapted for each wearer's size at each of various parts from the waist section 21 to the chest section 22. Thereby, the garment can be adapted for many wearers who may have various different proportions of waist and chest measurements. For example, for a wearer who has a large chest measurement relative to the waist measurement, the free lengths between the fastener portions 5 of the elastic cords 4 disposed in the waist section 21 are shortened like the lengths indicated at (a1) or (b1) in FIG. 9, while the free lengths between the fastener portions 5 of the elastic cords 4 disposed in the chest section 22 are lengthened like the length indicated at (c1) in FIG. 9. Or, for example, for a wearer who has a large waist measurement such as a pregnant woman, the free lengths between the fastener portions 5 of the elastic cords 4 disposed in the waist section 21 are lengthened like the length indicated at (c1) in FIG. 9, while the free lengths between the fastener portions 5 of the elastic cords 4 disposed in the chest section 22 are shortened like the lengths indicated at (a1) or (b1) in FIG. 9.

Moreover, because the elastic cords 4 have elasticity, fine adjustment of the waist or chest size in each part can be achieved due to the stretching properties of the elastic cords 4, and further the elasticity of the elastic cords 4 can provide a better fit for the body. Namely, the free length of each elastic cord 4 (La of (a1), Lb of (b1), Lc of (c1) in FIG. 9) is adjusted to a length somewhat shorter than the length corresponding to the waist or chest measurement of each part of the wearer's body, so that, when the garment is worn, the elastic cords 4 are stretched to some extent (see Ma of (a1), Mb of (b1), Mc of (c1) in FIG. 9) and the upper garment part 2 can be made to fit the body due to the restoring force of the elastic cords 4. This can also prevent misalignment of the garment 1 when being worn and improve wear comfort.

While it would ordinarily be difficult to make a garment of the known art fit wearers having different body sizes or shapes only with the elasticity of the elastic cords 4, the free length between the fastener portions 5 of each elastic cord 4 is changed individually in this embodiment. The synergy effects of the free length adjustment of the elastic cords 4 (for example changes between (a1), (b1), (c1) in FIG. 9) and the elasticity or stretching properties of the elastic cords 4 (for example the stretching and shrinking between (a1) and (a2), (b1) and (b2), (c1) and (c2) in FIG. 9) make it possible to accommodate various different body sizes and shapes of wearers.

Namely, if the elastic cords 4 were affixed to the body fabric portion 23 at both ends so that the free lengths between the fastener portions 5 were not changeable, the garment could not be adapted for a waist or chest measurement that is smaller than the waist or chest size of the garment when the lengths of the elastic cords 4 equal their free lengths. On the contrary, if the waist or chest size of the garment when the lengths of the elastic cords 4 equal their free lengths were too small, the garment could not be adapted for a large waist or chest measurement with the elasticity of the elastic cords 4 alone. It would be even more impossible to adapt the garment for many wearers who may have various different proportions of waist and chest measurements.

On the other hand, if the free length adjustability of the elastic cords 4 is combined with the elasticity of the elastic cords 4, the garment can be adapted or adjusted for wearers of various sizes, as well as for many wearers who may have various different proportions of waist and chest measurements.

More specifically, for example, if the garment is to be adapted only with the stretching properties of the elastic cords, it can only be adapted for one larger size and one smaller size (sizes 6 to 8 if the garment is manufactured as a size 7), whereas this embodiment, which utilizes the free length adjustability of the elastic cords 4 and the elasticity of the elastic cords 4, can be adapted for three larger sizes and three smaller sizes (sizes 4 to 10 if the garment is manufactured as a size 7).

The size adjustment only requires adjustment of the free length between the fastener portions 5 of each elastic cord 4 before the garment is worn, and so the adjustment work is easy. Moreover, since it is not necessary to make adjustments while the garment 1 is being put on the wearer during dressing, the wearer's burden is reduced, and even the wearer can perform the adjustment for herself.

Also, since no size alteration is required, no sewing operation is required for the garment 1 so that there are no worries that the garment 1 may be damaged.

For sellers or renters of the garment 1, too, there is an advantage that they do not have to keep an inventory of many sizes for the garment 1 of the same design. They will instead be able to have an inventory of garments 1 of various different designs at lower prices, leading to another advantage of a wider range of design selections for users such as buyers.

One of the fastener portions 5 of the elastic cords 4 is a stationary fastener portion 51, while the other of the fastener portions 5 is a movable fastener portions 52, as shown in FIG. 1. Therefore, attachment strength of the elastic cords 4 to the body fabric portion 23 can be ensured. It also simplifies the structure of the garment 1, and enables the garment 1 to be readily producible at low cost.

Each movable fastener portion 52 is made up of a plurality of buttonholes 521 and one button 6, and formed such that the free length between the fastener portions 5 can be adjusted by engaging the button 6 with one of the buttonholes 521. Therefore, the adjustment of the free length between the fastener portions 5 can be performed easily.

The upper garment part 2 includes patch portions 27 that cover the buttons 6 from the side of the wearer's body as shown in FIG. 5 and FIG. 6, so that the buttons 6 are prevented from contacting the body when the garment 1 is worn, whereby the wear comfort is improved.

The garment 1 is a one-piece garment having a lower garment part 3 formed integrally with the upper garment part 2 as shown in FIG. 4. Therefore, because of the heavyweight of the entire garment 1 including the lower garment part 3, it is necessary for the elastic cords 4 in the upper garment part 2 to have a larger force for retaining the garment 1 on the body. Therefore, it is of great significance that the garment 1 is retained at its upper garment part 2 on the upper half of the body by adjusting the free lengths between the fastener portions 5 of the elastic cords 4 as in the present invention to make the upper garment part 2 fit the upper half of the body.

Namely, if the waist or chest size is adjusted with non-elastic strings or the like without using the elastic cords 4, a sufficient retaining force to keep the garment 1 on the body cannot be obtained, which may cause an unwanted possibility of the garment 1 slipping off while being worn. On the other hand, such worries can be resolved by using the elastic cords 4.

The garment 1 is a so-called bustier dress, which is secured to the wearer's body only at the waist section 21 and the chest section 22 of the upper garment part 2; as a result, the upper garment part 2, in particular, requires the force provided by the elastic cords 4 to retain the garment 1 on the body. Namely, if the garment had shoulder portions or shoulder straps, the weight of the garment could be supported by the shoulder portions or shoulder straps; however, if these are not present, the garment 1 must be retained on the body by the force that tightens up the waist section 21 and the chest section 22 of the upper garment part 2 onto the upper half of the body. Therefore, it is of great significance that the garment 1 is retained at its upper garment part 2 on the upper half of the body by adjusting the free lengths between the fastener portions 5 of the elastic cords 4 as in the present invention to make the upper garment part 2 fit the upper half of the body.

The garment 1 includes the covering cloth portions 7 as shown in FIG. 2 to FIG. 5, whereby it can have an improved appearance design quality. Namely, the side portions 25 of the body fabric portion 23 where the elastic cords 4 are attached are particularly prone to wrinkles. Even if the design is such that wrinkles are permissible, the wrinkles may sometimes turn out to be aesthetically displeasing depending on how the adjustment was done. Therefore, by covering such parts with the covering cloth portions 7, the garment 1 can have an improved appearance design quality.

The elastic cords 4 are arranged in both of left and right side portions 25, so that the upper garment part 2 can be made to fit the body with a good balance. Also, since the parts where the elastic cords 4 are attached are not conspicuous in appearance, the garment 1 as a whole can have an improved appearance design quality.

As the garment 1 of this embodiment is a wedding dress, the effects of the present teachings can be fully achieved. Namely, since wedding dresses are worn only at weddings and are very expensive, it is usually arduous to make them to order. Therefore, the wedding dress is particularly desired to be adaptable or adjustable for wearers of various different body sizes or shapes.

It is common for a bride to be busy for the wedding, not only having to prepare the wedding dress, and so it is arduous for her to do many trial fittings for fine adjustment for any necessary alterations. It is also not unusual that the bride loses or gains weight shortly before the wedding. In such a case, too, the garment 1 of this embodiment can be readily adapted. There is another advantage that even for a bride who is pregnant, the garment can be adapted shortly before the wedding for a body shape that changes day by day.

Furthermore, since the wearer wants her appearance to be particularly good when wearing the wedding dress, by utilizing a garment 1 of the present embodiment that can be easily made to fit the bride's body shape, the desired effects can be readily achieved.

The present embodiment is also particularly advantageous with rental garments, because the characteristic feature of a rental garment is that a single garment article is worn by many individuals. Because garments according to the present embodiment can be readily adapted or adjusted for wearers of various different body sizes and shapes, such a garment can fully meet the needs characteristically associated with rental garments.

Moreover, renters no longer need to keep an inventory of many sizes for the garment of the same design. They will instead be able to have an inventory of garments of various different designs at lower prices, leading to another advantage of a wider range of design selections for users.

As described above, according to this embodiment, a garment can be provided that has good wear comfort and that can, with one size, be easily made to fit wearers' bodies of various different body sizes and shapes.

While the above embodiment has been described as being a wedding dress, the present invention is not limited in this respect. The present teachings can also be readily applied to, for example, stage costumes, evening dresses, and uniforms, and in addition, to garments that especially need to look good on the wearer, and to garments that need to be adapted for wearers of various different body sizes and shapes with a small number of garment sizes. The present teachings can also be effectively applied to ordinary maternity clothing in the respect that it can accommodate changes in body shape. The invention is not limited to these, however, and can be applied to various types of clothing such as ordinary clothes for women and children.

From the viewpoint of sales methods, the present garments, which can be adapted for wearers of various different body sizes and shapes, are also suitable for mail-order sales or rentals utilizing the Internet or the like, or as a gift.

While the movable fastener portion 52 of the elastic cords 4 in the embodiment described above is made up of the buttonholes 521 and the button 6, other means other than this can be used, such as hooks.

The number of elastic cords 4 arranged from the waist section 21 to the chest section 22 is six each for the left and right parts, but this number can be suitably changed in accordance with the design or the like of the garment 1.

The invention claimed is:

1. A garment including:

an upper garment part configured to be worn on an upper half of a wearer's body, the upper garment part having a circumference and a body fabric portion comprising an inner fabric layer and an outer fabric layer, wherein a first plurality of through-holes and a second plurality of through-holes each respectively extend in a substantially horizontal direction between the inner and outer fabric layers from a waist section to a chest section, the first plurality of through-holes being disposed in parallel at least in a left side portion of the upper garment part, the second plurality of through-holes being disposed in parallel at least in a right side portion of the upper garment part, and the first plurality of through-holes are not connected to the second plurality of through-holes, a first plurality of elastic cords respectively extending through the first plurality of through-holes, and a second plurality of elastic cords respectively extending through the second plurality of through-holes, wherein each of the first and second elastic cords:

(i) extends around only a portion of the upper garment part, (ii) has two ends in a longitudinal direction thereof, which ends are not connected to each other, (iii) has two fastener portions secured to the body fabric portion at two respective locations in the longitudinal direction thereof and (iv) is formed so that a free length between the two fastener portions is adjustable independently of the other elastic cords, wherein one of the fastener portions of each elastic cord is a stationary fastener portion comprising one end of the elastic cord immovably fixed to the body fabric portion, the other fastener portion comprises a movable fastener portion that is movable in the longitudinal direction of the elastic cords and a stationary fastener component immovably fixed to the body fabric portion, the movable fastener portion being detachably engageable with the stationary fastener component at at least two different locations in the longitudinal direction of the respective elastic cord, and the entire circumference of the upper garment part is adjustable to different circumferential lengths from the waist section to the chest section.

2. The garment according to claim 1, wherein each movable fastener portion comprises a plurality of buttonholes and the stationary fastener component comprises a button immovably fixed to the body fabric portion and wherein each movable fastener portion is formed such that the free length between the stationary and movable fastener portions is adjustable by engaging the button with a different one of the buttonholes.

3. The garment according to claim 2, wherein the upper garment part further includes a patch portion that covers the buttons on an interior side of the upper garment part that contacts the wearer's body.

4. The garment according to claim 1, further including a lower garment part configured to be worn on a lower half of the wearer's body, the lower garment part being formed integrally with the upper garment part.

5. The garment according to claim 1, wherein the garment is configured to be secured to the wearer's body only at the waist section and the chest section of the upper garment part.

6. The garment according to claim 1, further including a covering cloth portion that covers, from the outside, a part of the body fabric portion where the elastic cords are attached.

7. The garment according to claim 1, wherein the first and second plurality of elastic cords are respectively disposed substantially only on the left and right side portions of the upper garment part and do not extend across a front portion of the upper garment part.

8. The garment according to claim 3, wherein the garment is a wedding dress and further includes:

a lower garment part configured to be worn on a lower half of the wearer's body, the lower garment part being formed integrally with the upper garment part and a covering cloth portion that covers, from the outside, a part of the body fabric portion where the elastic cords are attached, and wherein the garment is configured to be secured to the wearer's body only at the waist section and the chest section of the upper garment part and wherein the first and second plurality of elastic cords are respectively disposed substantially only on the left and right side portions of the upper garment part and do not extend across a front portion of the upper garment part.

9. The garment according to claim 1, wherein the stationary fastener portion of each elastic cord is sewn onto the body fabric portion.

10. A garment including:

an upper garment part configured to be worn on an upper half of a wearer's body, the upper garment part having a circumference and a body fabric portion comprising an inner fabric layer and an outer fabric layer, wherein a plurality of substantially horizontal through-holes extend at least substantially in parallel between the inner and outer fabric layers from a waist section to a chest section, a plurality of stationary fastening components immovably fixed to the body fabric portion, a plurality of elastic cords respectively extending through the plurality of substantially horizontal through-holes, and wherein each elastic cord has a first end spaced from a second end in a longitudinal direction thereof, which first and second ends are not connected to each other, each first end of each elastic cord comprises a stationary fastener portion immovably fixed to the body fabric portion, each second end of each elastic cord comprises a movable fastener portion that is movable in the longitudinal direction of the respective elastic cord, the movable fastener portion providing at least two locations spaced in the longitudinal direction of the elastic cord that are each detachably engageable with at least one of the stationary fastening components, each elastic cord has a free length between its stationary fastener portion and the location of the movable fastener portion that is detachably engaged with the at least one of the stationary fastening components, which free length is adjustable independently of the other elastic cords, and the entire circumference of the upper garment part is adjustable to different circumferential lengths from the waist section to the chest section.

11. The garment according to claim 10, wherein the stationary fastener portion of each elastic cord is sewn onto the body fabric portion.

12. The garment according to claim 11, wherein each movable fastener portion comprises a plurality of buttonholes extending in the longitudinal direction of the elastic cord and the stationary fastening components each comprise at least one button immovably fixed to the body fabric portion, the buttonholes being configured to detachably engage the at least one button.

13. The garment according to claim 12, wherein the upper garment part further includes a patch portion that covers the buttons on an interior side of the upper garment part that contacts the wearer's body.

14. The garment according to claim 10, further including a lower garment part configured to be worn on a lower half of the wearer's body, the lower garment part being formed integrally with the upper garment part.

15. The garment according to claim 10, wherein the garment is configured to be secured to the wearer's body only at the waist section and the chest section of the upper garment part.

16. The garment according to claim 10, further including a covering cloth portion that covers, from the outside, a part of the body fabric portion where the elastic cords are attached.

17. The garment according to claim 10, wherein the elastic cords comprise a first and a second plurality of elastic cords respectively disposed substantially only on left and right side portions of the upper garment part, wherein no elastic cord extends across a front portion of the upper garment part.

18. The garment according to claim 13, wherein the garment is a wedding dress and further includes:

a lower garment part configured to be worn on a lower half of the wearer's body, the lower garment part being formed integrally with the upper garment part and a covering cloth portion that covers, from the outside, a part of the body fabric portion where the elastic cords are attached, and wherein the garment is configured to be secured to the wearer's body only at the waist section and the chest section of the upper garment part, and the elastic cords comprise a first and a second plurality of elastic cords respectively disposed substantially only on left and right side portions of the upper garment part, wherein no elastic cord extends across a front portion of the upper garment part.

* * * * *